United States Patent [19]

Walker

[11] Patent Number: 4,479,445

[45] Date of Patent: Oct. 30, 1984

[54] ADJUSTABLE EMBROIDERING TOOL

[75] Inventor: William H. Walker, Garden City, S.C.

[73] Assignees: Elwood D. Rexroat; Shirley J. Rexroat, both of Sanford, Fla.

[21] Appl. No.: 482,779

[22] Filed: Apr. 7, 1983

[51] Int. Cl.[3] ..... D05C 15/06

[52] U.S. Cl. ..... 112/80; 604/224

[58] Field of Search ..... 604/224, 171; 112/80; 223/104; 66/118

[56] References Cited

U.S. PATENT DOCUMENTS

| | | | |
|---|---|---|---|
| 1,611,878 | 12/1926 | Braudes | 112/80 |
| 2,610,598 | 9/1952 | Midas | 112/80 |
| 3,343,539 | 9/1967 | Moorhouse | 604/224 X |
| 4,135,458 | 1/1979 | Samoilov | 112/80 |
| 4,306,510 | 12/1981 | O'Brien | 112/80 |

*Primary Examiner*—Werner H. Schroeder

*Assistant Examiner*—Andrew M. Falik

*Attorney, Agent, or Firm*—Roger L. Martin

[57] ABSTRACT

An embroidering tool has an adjustable needle penetration capability and is formed from two interfitting components that are relatively rotatable about a common axis to provide the adjusting movement. One part has a cannulation needle assembly in accord with certain aspects of the invention and which at the proximal end of the needle thereof is encased in a plastic member which is a molded plastic product provided with an exterior flat screw thread. The other component is a unitary unmodified molded plastic structure with an interior wall that has a protuberance which is engaged by the thread of the outer part in the assembled structure of the tool. The two components snap together when they are assembled although modifications are contemplated to facilitate separate use of the needle carrying component from the other component.

6 Claims, 8 Drawing Figures

ADJUSTABLE EMBROIDERING TOOL

BACKGROUND OF THE INVENTION

This invention relates to an embroidering tool for use in forming loops of yarn or other material in a basic fabric.

Embroidering tools of the kind contemplated herein have a tubular needle which is mounted at one end of a finger manipulatable holder therefore. The holder has a passage which communicates with the proximal end of the needle so as to accomodate movement of a length of yarn through the holder and into the needle passage or hollow during use of the tool. The distal end of the needle is equipped with a laterally opening eye that communicates with the needle passage and here the yarn length is threaded through the eye and passes from the needle passage to the exterior of the needle during use of the tool.

In practice, the distal end of the needle is inserted in the back side of the basic fabric and from whence it passes to a point offset from the front side of the fabric before being thereafter withdrawn. Upon initial penetration of the basic fabric, the yarn at the exterior of the needle eye is frictionally engaged by the basic fabric material. As the needle is passed further through the fabric, the yarn length is pulled downwardly through the handle passage and needle passage until such time as the full hilt of the needle insertion is realized. Thereafter, as the needle length is withdrawn, a loop is formed at the front side of the basic fabric. As the eye containing distal end portion of the needle is withdrawn from the fabric, the fabric material closes in about the yarn at the opposite ends of the length portion of the yarn forming the loop so that the loop is thereafter maintained and frictionally held in place by the fabric material that surrounded the needle at the point of insertion and withdrawal. In practice, the insertion and withdrawal procedure is repeated with each point of insertion in the basic fabric being, in most cases, in an area which is proximate to the point of the previous withdrawal of the needle from the basic fabric. U.S. Pat. No. 2,565,135 (Kittener), U.S. Pat. No. 4,135,458 (Samoliov), and U.S. Pat. No. 4,306,510 (O'Brien) show typical prior art embroidering tools that employ a hollow needle through which the yarn is drawn during use and further illustrate the procedures involved in the use of such tools. Other embroidering tools and procedures are shown in the following U.S. Pat. Nos: 1,912,977 (Geerhart), 3,240,176 (Morrison), and 3,938,452 (Windall).

It will be appreciated that the size of the loop formed at the front side of the basic fabric is determined by the depth of penetration of the needle during use. This is normally determined in those embroidering tools that have a needle and holder which are relatively fixed by the location of the needle eye with respect to the adjacent end extremity of the holder. The adjacent end of the holder in such cases serves as a stop that engages the back side of the basic fabric and serves to limit the depth of needle penetration and thus the size of the loop formed during use. To shorten the depth of penetration and thus provide an element of variance in the sizes of the loops formed by such tools, small sleeve elements that fit over the needle are frequently provided by the tool manufacturers. These sleeve elements are of differing lengths and to decrease the depth of penetration, an appropriate sleeve length is selected for placement on the needle in abutting relation to the adjacent end extremity of the holder. The sleeve tightly fits on the needle and during use, the end of the sleeve which is offset from the end extremity of the holder serves to stop the advancement of the needle into the basic fabric to determine the depth of penetration and thus the size of loop formation.

In some types of embroidering tools of the hollow needle type, provisions are made for adjusting the location of the needle along the axis of the holder so that in effect a means is provided for adjusting the distance between the stop forming end extremity of the needle holder and the eye at the distal end of the needle. The Kittener, Samaloiv and O'Brien patents are illustrative of embroidering tools that are provided with adjustable needle capabilities.

One objection to known embroidering tools with adjustable needle capabilities is the inconvenience involved in making the adjustments. In some cases the tool parts must be disassembled and thereafter reassembled to make an adjustment. Yet another objection is to the inconvenience and often uncertainty in duplicating needle adjustments. In some tools there are no convenient provisions for indexing the adjustment to the depth of penetration of the needle and as such, a trial and error approach to duplicating a previous adjustment is often resorted to.

One main objection to known embroidering tools with adjustable needle capabilities resides with the manufacturer and involves the excessive costs that are required for manufacturing the known designs. Most embroidery tools of the kind contemplated are used for fine and delicate decorative embroidery work, and require the use of a hollow needle that is usually less than about 2 mm. in diameter. Tubular components of this size are incapable of withstanding large lateral pressures without being damaged and are not capable of low cost modification to solely supply the market demand for tools of the kind contemplated. As such, current manufacturers have resorted to the use of low cost cannulation needle assemblies which are currently being supplied to the medical field for use as components of devices and assemblies that are used in injecting and/or withdrawing fluids from the bodies of humans and other animals. Typical of such devices and components are those used in making hypodermic injections and withdrawing blood specimens in the subcutaneous tissues of the body. Such needle assemblies are being mass produced in such large quantities for the medical professional as to permit their modification for use as relatively inexpensive components for such embroidery tools. The Samiliov patent is representative of one such use of a cannulation needle assembly in an embroidering tool and wherein the assembly before incorporation and use in the tool structure may be simply modified by providing an appropriate eye at the distal end of the needle. Unfortunately, the use of such needle assemblies has been found objectionable by certain governmental bodies and agencies because the tools can be disassembled and the cannulation needle assemblies thereafter used as drug paraphenalia by unauthorized drug users. The need accordingly exists for a structural arrangement in a tool of the type contemplated herein that permits the use of a modified cannulation needle assembly but nevertheless effectively precludes the subsequent use of the modified assembly for such unauthorized purposes.

STATEMENT OF THE INVENTION

In accord with the invention, an embroidery tool with an adjustable needle penetration capability is provided in the form of two interfitting components or parts that are simply rotated relative to one another to provide the desired adjustment.

One part of the tool includes an elongated tubular needle that is mounted in one end of an elongated plastic member which is provided with a passage that opens to the exterior of the member at the other end. The passage communicates with the hollow portion of the needle and is adapted to pass a length of yarn to the proximal end of the needle during use of the tool. The elongated plastic member is a molded product in which the proximal end of the tubular needle is encased during the molding procedure. It also has an exterior cylindrical wall portion that is provided with a flat surface screw thread which is adapted to engage a wall portion of the other part of the tool in providing the adjustable needle capability. In accord with certain aspects of the invention, the tubular needle is provided in the structure of the parts as a component of a flange cannulation needle assembly which at its proximal end is encased in the molded product during its formation.

The other part of the tool is an elongated unitary structural component that is formed solely by molding procedures in accord with certain aspects of the invention. The component has an internal wall that defines a passage which extends between and opens through the opposite end extremities of the component. One portion of the internal wall defines an elongated cylindrical cavity which opens to the exterior at one end of the component and in which the needle end of the other component is received during the assembly of the two component tool. The other end of the unitary structural component serves as the stop which engages the back side of the basic fabric during use of the tool. Here, the needle of the component received in the passage projects through the end opening of the unitary component during use. The cylindrical portion of the internal wall has a small protuberance which is engaged by the screw thread of the unitary component in accord with one aspect of the invention. The molded plastic material used in forming the unitary component is sufficiently resilient to permit mold release of the molded product without the use of complicated molds whereas more costly procedures would be required to provide a threaded internal wall structure.

DESCRIPTION OF THE DRAWINGS

The novel features which are believed to be characteristic of this invention are set forth with particularity in the appended claims. The invention, itself, however, both as to its organization and method of operation, together with further objects and advantages thereof, may best be understood by reference to the following descriptions taken in connection with the accompanying drawings, wherein:

DESCRIPTION OF PREFERRED EMBODIMENT

Figure 1:
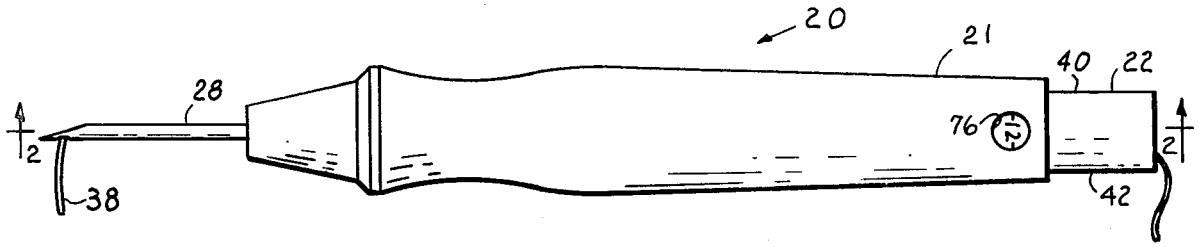
FIG. 1 is a side view of an embroidering tool embodying the principles of the invention and as seen with a length of yarn extending through one part of the tool.

Reference is now made to the preferred embodiment of the invention shown in the drawings and wherein the embroidering tool is designated at 20 and is seen as including two interfitting components or parts which are designated at 21 and 22 respectively.

Figure 7:
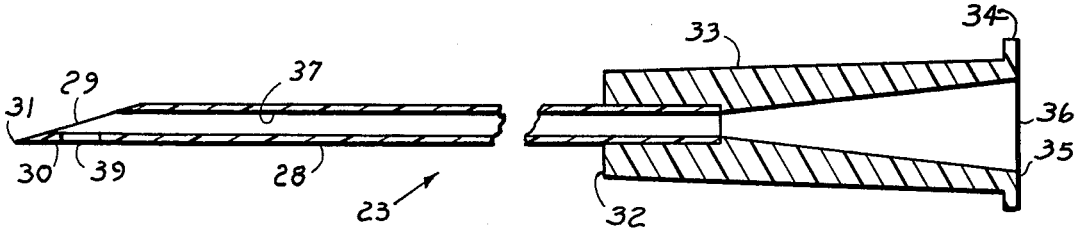
FIG. 7 is a sectional view of the cannulation needle assembly used in the formation of the tool part seen in FIGS. 3 and 4.

The center part or component 22 carries the needle of the tool 20 and includes a conventional cannulation needle assembly 23 which is commonly marketed for use in the medical field as a component of a hypodermic syringe. The cannulation needle assembly 23 is best illustrated in FIG. 7 and includes an elongated tubular metal element 28 which serves as the needle in the assembly and is provided with an inclined end surface 29 at its distal end 30. This provides a point at the end extremity 31 of the needle element 29 and which facilitates advancement of the needle into the subcutaneous regions of the body when the assembly is used in the medical arts. In the structure of the embroidering tool 20, the point furnished at the end extremity facilitates an initial and substantially unresisted parting of the fabric material as the needle penetrates the basic fabric during use.

At the proximal end 32 of the needle element 28, the assembly 23 is provided with a conically shaped hub 33 which is equipped with a radial flange 34 at its base end 35. This hub portion 33 of the assembly 23 has an end socket 36 which is adapted to receive the end of the tubular protuberance that is normally located on the barrel of a syringe and use in coupling the assembly to the barrel. In this instance, the socket 36 serves as a passage which communicates with the passage 37 through the needle element 28. The hub 33 in the illustration is made from molded plastic material that is formed about the proximal end 32 of the needle so that the latter is suitably fixed to the hub 33 in the assembled arrangement. Other suitable cannulation needle assemblies may be used, of course, including those in which the hub is made of a suitable metal and wherein the flange is adapted for use in coupling the assembly to a holder for evacuated containers that are used in withdrawing blood from patients.

The cannulation needle assembly 23 thus far described is of conventional design but to adapt the assembly 23 for use in the embroidery tools contemplated herein, the assembly 23 is modified by providing a hole 39 at the distal end 30 of the needle 28. This hole projects radially of the longitidinal axis of the needle and communicates with the exterior of the needle 28 and also with the needle passage 37 in the proximate area of the inclined end surface 29 as seen in FIG. 7. This hole 39 serves as the needle eye through which the length 38 of yarn or other material passes to the exterior of the tool in forming the loops during use.

Figure 3:
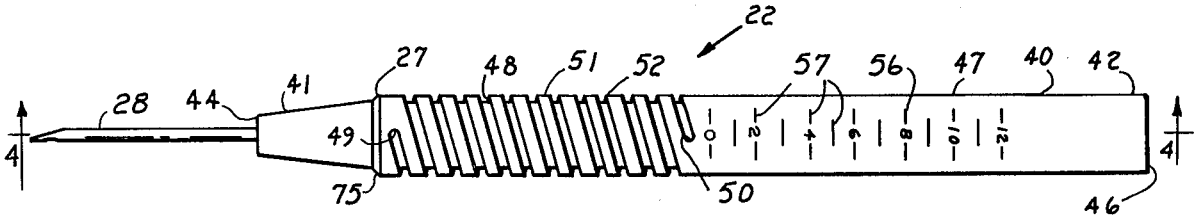
FIG. 3 is an enlarged side view of one part of the tool shown in FIG. 1.
Figure 4:
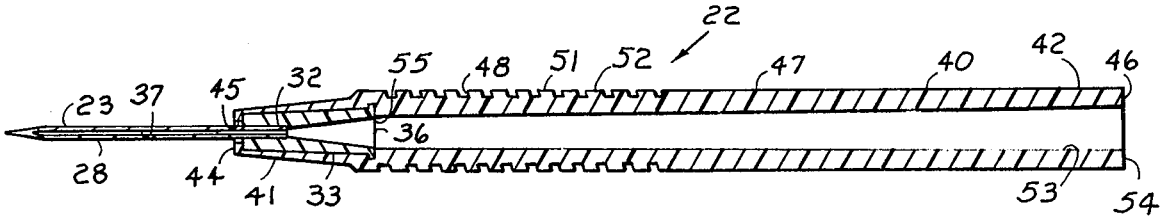
FIG. 4 is a longitudinal sectional view of the part seen in FIG. 3 and as taken along the lines 4—4 therein.

In addition to the needle assembly 23, the center part or component 22 of the embroidering tool 20 illustrated in the drawings includes an elongated molded plastic member that is designated at 40 and best shown in FIGS. 3 and 4. Member 40 has opposite end portions 41 and 42 and the proximal end 32 of needle 28 in the hub 33 of assembly 23 is encased in the plastic material at the end portion 41 of the member 40 during its formation by the molding procedures. This end portion 41 of member 40 is generally conical in shape and surrounds the hub of the needle assembly 23 in encapsulating the hub and proximal end of the needle in the plastic material. The end extremity 44 of member 40 has an axially arranged hole 45 that is formed as the hub is encased in the end portion 41 during the molding procedure, and here the needle element 28 emerges from the plastic structure of the member 40 as seen in the drawings.

Member 40 has a cylindrical exterior wall 47 that extends between the conical end portion 41 and the other end extremity 46 of member 40. This wall 47 is provided with an elongated helical groove 48 which has opposite ends 49 and 50. The one end 49 of groove 48 is offset inwardly from the end 27 of the cylindrical wall 47 adjacent the needle whereas the other end 50 of groove 48 is generally located intermediate the opposite end extremities 44 and 46 of member 40.

The arrangement of the groove 48 is such as to provide a helical screw thread 51 with a flat surface 52. This screw thread 51, as will be subsequently seen, is used in providing the adjustable needle penetration capability for the embroidery tool 20. Between the end extremity 46 of member 40 and the inner end 50 of groove 48, the outer cylindrical wall 47 of the member is provided with indicia 56 such as the longitudinally faced apart marks 57 that are shown in FIG. 3. These marks 57 are spaced apart in accord with the spacing between the convolutions of thread 51 and, as will be subsequently seen, may be indexed with reference to the outer part 21 of the tool 20 to indicate the depth of penetration to be expected at any one position of adjustment of the interfitting parts 21 and 22. These marks 57 are preferably molded as recessed indicia in the external wall 47 of member 40 during the molding procedure.

To facilitate passage of the length 38 of yarn to the proximal end 32 of the needle 28 during use of the tool 20, member 40 is formed during the molding procedure with an elongated passage 53 that is arranged in coaxial relation to the axis 43 of the component 22. At one end 54 of this passage 53, the passage opens to the exterior of the component 22 through the end extremity 46 of the molded plastic member 40. At the other end 55 of the passage 53, the passage 53 communicates with passage 37 in the needle via the socket 36 in hub 33.

The elongated outer part or component 21 of the embroidering tool 20 is an unmodified unitary molded structure which is formed from plastic material. The structure is unmodified in the sense that the molded structure is ready for use as a component of the tool following its formation by the molding procedures and without the need for further modification by machining, drilling, or other material cutting procedures.

Figure 5:
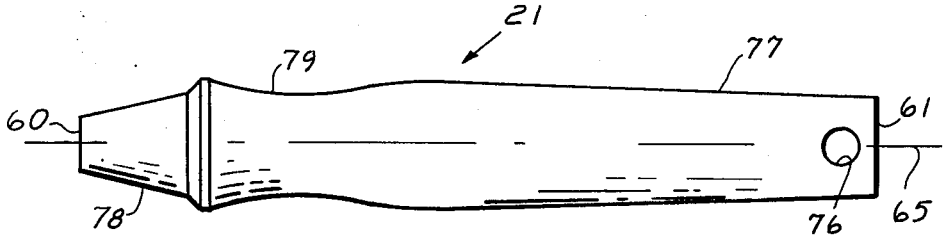
FIG. 5 is an enlarged view of the other part of the tool seen in FIG. 1.
Figure 6:
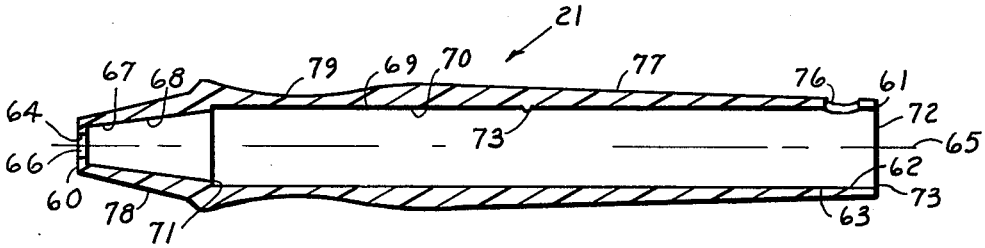
FIG. 6 is a longitudinal sectional view of the part seen in FIG. 5 and as taken along the lines 6—6 therein.

As seen in FIGS. 5 and 6, the molded outer component 21 has opposite end extremities 60 and 61 and an internal wall 62 that defines a passage 63 which extends between such extremities 60 and 61. The end 60 of component 22 serves as a stop which engages the back side of the basic fabric to limit the needle penetration during use of the tool and here, the interior wall 62 has a small cylindrical wall portion 64 which is arranged in coaxial relation with the longitudinal axis 65 of the component 21 to provide an opening 66 through which the needle 28 of component 22 projects to the exterior of the component 21 during use of the tool 20. Adjacent the opening 66, the interior wall 62 is provided with a wall portion 67 that converges toward the axis 65 of part 21 and defines a truncated conical cavity 68 which is adapted to receive the conical end portion 41 of the molded member 40 when the tool 20 is so adjusted that the needle element 28 is fully extended through the opening 66. As seen in FIG. 6, the truncated cacity 68 and end opening 66 are coaxially arranged with respect to each other and with respect to an elongated cylindrical cavity 69 that is defined by a cylindrical wall portion 70 of the internal wall 62. This cavity 69 communicates at its inner end 71 with the conical cavity 68. At its opposite end 72, the cavity 69 communicates with the exterior of the component 21 through an opening 73 which is defined by the wall at the end extremity 61 of component 21.

Figure 8:
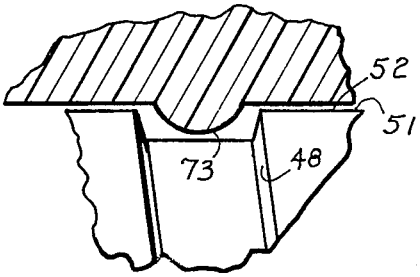
FIG. 8 is an enlarged view of a fragment of the tool with certain parts shown in section.

Between the opposite ends 71 and 72 of the cylindrical cavity 69, the cylindrical wall portion 70 is provided with a small protuberance 73 in the form of a spherical segment with a height dimension that is substantially less than the radius of the sphere as will be seen in FIG. 8. This wall protuberance 73 is adapted to fit the groove 48 in the external wall 47 of the center component 22 when the parts are fitted together in the assembled tool. As thus engaged by the helical thread 51, when the parts are rotated relative to one another about the common axis in the assembled tool, the threaded engagement causes the parts to move relative to one another along the common axis.

The internal cylindrical wall portion 70 of component 21 has a diameter which is slightly larger than that of the exterior of cylindrical wall portion 47 of component 22. As such, the respective parts may be assembled by first passing the needle end of the center component 22 through the opening 73 at the end 61 of component 21 and thence into the cylindrical cavity 69. Thereafter the cylindrical portion of the center tool component 22 is able to freely pass into the cavity 69 until the conical end portion 41 has attained a position in the cavity between the protuberance 73 and the inner end 71 of the cavity. At this point, axial movement of the center part 22 toward the opening 66 is obstructed as the protuberance 73 is encountered by the inclined exterior wall designated at 75 and located between the end 27 of cylindrical wall 47 and the conical end portion 41 of the component 22 as seen in FIG. 3. When this wall 75 encounters the protuberance 73, a sharp tap on the end 46 of component 22 while resisting axial movement of component 21 will force the plastic material used in the formation of the parts 21 and 22 to yield sufficiently to enable the protuberance 73 to ride up the surface of the inclined wall 75 and over the end 27 of the cylindrical wall 47 into the nearest convolution of the groove 48. As this happens and the plastic material recovers from its deformation, the protuberance 73 snaps into place in the groove 48. Thereafter by rotating the center component 22 with respect to the outer component 21 about the common axis 74 of the assembly, through manipulation of the end portion 42 of component 22 with the fingers of one hand while grasping the outer component 21 with the other hand, the needle can be moved along the common axis and out through the opening 66 in the outer component 21 to the desired position of adjustment. In this respect, the outer component 21 of the tool has a lateral opening 76 that communicates with the cylindrical cavity 69 adjacent to the end extremity 61 of component 21. This opening 76 serves as a point of reference through which the marks 57 on component 22 may be observed during adjustment of the tool parts so as to indicate the relative location of the distal end 30 of the needle 28 with respect to the stop forming end extremity 60 of the unitary component 21.

The exterior wall 77 of the unitary component 21 is suitably contoured and provided with a truncated conical wall portion 78 at the end 60 of the component 21. This wall portion 78 converges toward the axis 65 at a point offset from the end 60 so as to provide an unobstructed view of the distal end 30 of the needle 28 throughout practically the full range of needle adjustment provided in the tool 20. Adjacent the conical wall portion 78 of component 21, the exterior wall 77 is provided with a shallow arcuate concavity or recess area 79 that surrounds the axis and serves as a comfortable finger gripping area for the user of the tool.

Figure 2:
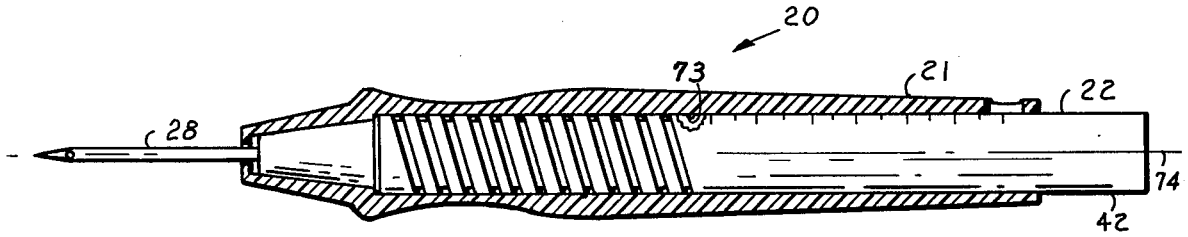
FIG. 2 is a longitudinal section through the tool as seen along the lines 2—2 of FIG. 1.

As evident from FIGS. 1 and 2, the end portion 42 of component 22 is located exteriorly of the unitary component 21 in the assembled embroidery tool 20. As such, rotative manipulation of the component 22 about the common axis 74 with respect to component 21 is accomplished by the finger manipulation of the end portion 42 with the fingers of one hand while the other component is grasped and manipulated through the use of the other hand.

It will be evident that by encapsulating the hub and distal end of the needle of assembly 23 in the end portion 41 of member 40 that the use of the cannulation needle assembly as drug paraphenalia is effectively precluded as a practical matter. As such, use of such assemblies in the manufacture of such tools is rendered unobjectionable to most governmental agencies and bodies, and the low cost source of needle may be effectively used by manufacturers of the tools contemplated herein. Simple needles provided with suitably pointed ends and appropriate eyes may, of course, be also used instead of the cannulation assemblies. Again, however, the costs in such cases would normally be higher unless the costs may be spread into other products using such needles.

The flat threaded arrangement for the outer component 22 has certain advantages in that it provides a comfortable grip for the use of the component 22 as an embroidery tool without the need for the other component 21. As such, the center component 22 may be marketed separately and apart from the outer component 21 as an embroidery tool that lacks the adjustable needle penetration capabilities found in the tool of the instant invention. However, to compensate for this lack of adjustability, tight fitting plastic sleeves of varying length may be provided for selective use and application to the needle to limit the penetration as is common practice for many tools of the nonadjustable type now found in the marketplace.

Yet another advantage in accord with certain aspects of the invention is that a quick separation of the components 21 and 22 may be realized by carrying the end 49 of the helical groove into the inclined wall 75 area to avoid the snap type locking procedure described with reference to the preferred embodiment. This would permit several needle carrying components, like part 22 with differing needle sizes (diameters) and with yarns of different color and/or size, to be used with but one outer component. This would thus permit interchanging of the center parts and a realization of the adjustable needle penetration capabilities without the costs associated with the procurement of an outer part 21 for each center part 22 being used.

Polystyrene is a preferred plastic material used in molding the unitary structure 21 and in encapsulating the needle in the plastic member 40. The specific plastic material used forms no part of the invention. However, such material must be capable of being used in molding the components of the members contemplated and must provide the necessary resiliency to yield when the snap-in interfitting structural aspects contemplated by the preferred embodiment are being employed in the structure of the tool.

While only a certain preferred embodiment of this invention has been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. An embroidering tool comprising a pair of elongated interfitting components that have a common axis and are relatively rotatable about said axis, one of said components being a unitary structure molded from plastic material and having opposite ends, an interior wall which defines an elongated coaxially arranged cylindrical cavity that opens to the exterior of said one component at one of said opposite ends, and an end opening that communicates with the cylindrical cavity and is coaxial therewith at the other of said opposite ends, the other of said interfitting components being arranged so that it extends through said cylindrical cavity and has an elongated tubular needle which extends through said end opening and has a proximal end that is located in the interior of said one of said interfitting components, a distal end that is located at the exterior of said one of said interfitting components, and a passage extending through the needle and communicating with the exterior thereof at each of the proximal and distal ends thereof, and an elongated member that is molded from plastic material and has opposite end portions which include one end portion that is located exteriorly of said one of said interfitting components at said one of said opposite ends thereof, and another end portion that is located in the interior of said one of said interfitting components at the other of said opposite ends, and an exterior cylindrical wall that extends between said opposite end portions, said proximal end being encased in the plastic material of the other end portion of said elongated member, said member having a passage which extends axially along said common axis and communicates with the needle passage at the proximal end thereof and with the exterior of said other of said interfitting components through said one end portion of said elongated member, said exterior cylindrical wall having a screw thread, said interior wall having a protuberance that is engaged by said screw thread, and said screw thread and protuberance being so adapted and arranged that such relative rotation of said interfitting components causes relative movement of said interfitting components along said axis.

2. An embroidering tool in accord with claim 1 where said exterior cylindrical wall has an end which is inwardly offset along said common axis from said other of the end portions of said elongated member, said screw threads define a helical groove having an end which is offset from said other of said end portions of said elongated member, said protuberance is located in said groove, and said other of said end portions of said elongated member and said exterior cylindrical wall are separated by an inclined wall that is encountered by said protuberance during the assembly of said first and second components.

3. An embroidering tool comprising a cannulation needle assembly which apart from said tool is adapted for use in making hypodermic injections and has an elongated tubular metal needle with a distal end, a proximal end, and a passage which extends between and communicates with the exterior of the needle at each of the proximal and distal ends thereof, and a hub that is fixed to the proximal end of the needle and has a socket which communicates with said passage at said proximal end, an elongated unmodified unitary first component which is molded from plastic material and has a longitudinal axis, opposite ends, an interior wall that defines an interiorly located cylindrical cavity which is arranged coaxial with said longitudinal axis and opens to the exterior of said first component at one of said opposite ends, and an end opening which communicates and is coaxial with the cylindrical cavity at the other of said opposite ends, and an elongated second component which extends through said cylindrical cavity and is coaxially arranged with respect to said longitudinal axis, said second component including said connulation needle assembly, and an elongated member which is molded from plastic material and has opposite end portions that include one end portion which is located exteriorly of said first component and at said one of said opposite ends and another end portion in which the hub and proximal end of the needle are encased, and an elongated passage which extends between said opposite end portions and communicates with the exterior of said second component through said one end portion and with the needle passage at said other end portion, said elongated member and said elongated needle being coaxially arranged with respect to each other and with respect to said longitudinal axis, said needle being arranged so that it extends to the exterior of the first component through said end opening, said second component being relatively rotatable about said longitudinal axis with respect to said first component, said elongated member having a cylindrical exterior wall with a screw thread therein, and said interior wall having means threadingly engaged by said screw thread, whereby said first and second components are relatively axially movable in response to said relative rotation to thereby adjust the location of said distal end of said needle with respect to said other of the opposite ends of said first component.

4. An embroidering tool in accord with claim 3 wherein the threadingly engaged means is a small protuberance which is located in said interior wall and projects into said cavity.

5. An embroidering tool in accord with claim 3 wherein said cylindrical exterior wall has indicia which is indicative of the adjusted location of said distal end with respect to said other of the opposite ends of said first component and which is indexed by reference to said first component.

6. An embroidering tool in accord with claim 3 wherein said screw thread has a flat surface and defines a helical groove in said exterior wall and in which said threadingly engaged means of said interior wall is located.

* * * * *